US005678612A

United States Patent [19]

Derudder et al.

[11] Patent Number: 5,678,612

[45] Date of Patent: Oct. 21, 1997

[54] JACQUARD MACHINE WITH PLURAL LIFTER DEVICES

[75] Inventors: Carlos Derudder, Heule; Dewispelaere André, Marke, both of Belgium

[73] Assignee: N.V. Michael Van de Wiele, Kortrijk-Marke, Belgium

[21] Appl. No.: 575,064

[22] Filed: Dec. 19, 1995

[30] Foreign Application Priority Data

Dec. 20, 1994 [BE] Belgium ..... 09401142

[51] Int. Cl.[6] ..... D03C 3/12; D03C 3/06

[52] U.S. Cl. ..... 129/657; 139/21

[58] Field of Search ..... 139/59, 65, 21

[56] References Cited

U.S. PATENT DOCUMENTS

| | | | |
|---|---|---|---|
| 4,858,654 | 8/1989 | DeRudder | 139/65 |
| 5,038,837 | 8/1991 | Palau et al. | 139/65 |
| 5,139,052 | 8/1992 | DeRudder | 139/65 |
| 5,353,846 | 10/1994 | Gheysen et al. | 139/65 |
| 5,522,435 | 6/1996 | DeRudder | 139/65 |
| 5,540,262 | 7/1996 | Bassi et al. | 139/65 |

FOREIGN PATENT DOCUMENTS

| | | |
|---|---|---|
| 529019 | 6/1954 | Belgium . |
| 9300411 | 4/1993 | Belgium . |
| 280132 | 8/1988 | European Pat. Off. . |
| 399930 | 11/1990 | European Pat. Off. . |
| 459582 | 12/1991 | European Pat. Off. . |
| 570947 | 11/1993 | European Pat. Off. . |
| 627511 | 12/1994 | European Pat. Off. . |
| 75506 | 5/1958 | France . |
| 2648159 | 12/1990 | France . |

*Primary Examiner*—Andy Falik
*Attorney, Agent, or Firm*—James Creighton Wray

[57] ABSTRACT

Jacquard machine with lifter device has a first (1) and a second lifter element (2). The lifter elements are suspended from at least one hook (3, 4), (5, 6) respectively, which hook can be selected to be carried along by one of two knives (7'), (8') moving up and down in counterphase. A reversing roller (9') is provided. A lifter cord (10) is attached by one end (10') to a part of the device and is passed in succession over a roller (1') of the first lifter element (1), the reversing roller (9') and a roller (2') of the second lifter element (2). The other end of the cord is connected to one or more harness cords for lifting at least one warp thread on a weaving loom. First and second grates are provided on the machine. The reversing roller (9') is attached on a first grate (12). Each grate (12), (11) optionally can be disposed either in a fixed position or in a movable position such that it can be set in motion up and down in phase with one of the knives (7'), (8'). The Jacquard machine is convertable from a three-position Jacquard machine to a four-position Jacquard machine, and vice-versa, or to a five-position Jacquard machine, and vice-versa.

15 Claims, 12 Drawing Sheets

JACQUARD MACHINE WITH PLURAL LIFTER DEVICES

BACKGROUND OF THE INVENTION

The present invention relates to a jacquard machine with lifter device, comprising a first and a second lifter element, suspended from at least one hook respectively, which hook can be selected to be carried along by one of two knives going up and down in counterphase; a reversing roller; and a lifter cord which is attached by one end to a part of the device and is passed in succession over a roller of the first lifter element, the reversing roller and a roller of the second lifter element, and which is connected by the other end to one or more harness cords for lifting at least one warp thread on a weaving loom.

Such a jacquard machine with lifter device is known, as emerges from the description and the drawings of European Patent No. 0,399,930. In the case of this known jacquard machine the lifter cord end and the reversing roller are attached to the same fixed part of the device.

This known jacquard machine is designed with two hooks per lifter element, and one hook can be selected to be carried along by one knife, while the other hook can be selected to be carried along by the other knife. Each lifter element comprises a top and a bottom lifter roller. The two hooks interacting with a lifter element are connected to each other by a cord which is passed under the top lifter roller of said lifter element, while the lifter cord is passed over the bottom lifter roller of said lifter element.

Each lifter element is thus suspended with the top lifter roller in the downward hanging loop of a cord which connects two hooks. The two hooks interacting with a lifter element are known as complementary hooks.

Such a jacquard machine is provided for interaction with a weaving loom, in order to manufacture fabric from weft threads and warp threads by in each case forming a shed between the warp threads and inserting at least one weft thread in said shed. During the formation of each shed the position of each warp thread relative to the weft thread(s) to be inserted is determined as a function of the desired weave between weft threads and warp threads. The jacquard machine is controlled to take the warp threads into the desired position for each shot (i.e. the insertion of one or more weft threads).

Each hook optionally either can not be selected, so that it is not carried upwards by a knife and thus remains in its lowest position, or can be selected, so that it is carried along by a knife and carries out an up and down movement. The selection of the hooks is carried out by generally known means.

A lifter element in which neither of the complementary hooks has been selected is therefore situated in a down position. A lifter element in which one complementary hook has been selected will make an up and down movement together with the knife. When the knife has been raised to its up position over a height $h_1$, the lifter element will be situated at a height $h_1/2$ above its down position. This is the top position of the lifter element.

A lifter element in which two hooks are selected remains in its up position, since both hooks make an up and down movement in counterphase.

When a first and a second lifter element are both in the down position, the lifter cord end connected to one or more harness cords is situated in its lowest position. The warp threads are thus also situated in their lowest position. When one of these two lifter elements is in the up position, and the other lifter element is in the down position, the abovementioned lifter cord end has been taken to a height $h_1$ above its lowest position. The warp threads have then also been raised to a height $h_1$ above their lowest position. When both lifter elements are in their up position, the warp threads have been raised to a height $2\times h_1$ above their lowest position.

By selected or not selecting the respective hook which interact with a first and a second lifter element, the warp threads can be taken optionally into one of three possible positions, a lowest position, a middle position at a height $h_1$, and a highest position at a height $2\times h_1$.

Jacquard machines with the features from the first paragraph of this description, in which each lifter element is suspended from one hook, do exist. The down position of a lifter element in that case can be obtained by not selected the hook for it to be carried along by a knife, so that said hook remains in its lowest position.

If the hook has been selected, the lifter element is set in motion up and down, together with one of the knives. A lifter element can be retained in its up position through the fact that each hook can be selected to remain suspended in its top position. By taking the respective interacting (first and second) lifter elements into the up position or the down position, the warp threads optionally can be moved into one of three possible positions, as described above.

However, a disadvantage of these known jacquard machines is that the warp threads can be taken into only three positions, while for the manufacture of certain fabrics it is necessary to be able to take the warp threads into four or five positions.

Belgian Patent Application No. 09300411, filed on Apr. 23, 1993, discloses a jacquard machine by means of which the warp threads can be taken into four different positions by the same lifter device. This lifter device comprises a lifter element with a top and a bottom lifter roller, two complementary hooks which are connected by a cord which is passed under the top roller of the lifter element, a grate which is immovably connected to one of the knives and is thus set in motion up and down in phase with said knife, a reversing roller attached on said grate, and a lifter cord which is connected by one end to a hook, is passed in succession over the reversing roller and the bottom roller of the lifter element, and is connected by the other end to a heald for lifting warp threads.

Each hook can either move along with a knife or be selected to remain in its top position.

If the knife which does not carry along the grate is in its lowest position, while the hook interacting therewith a) has not been selected, the heald is in its lowest position;

b) has been selected, the heald is at a height $2\times h_1$ above its lowest position.

If the knife which carries along the grate is in its lowest position, while the hook interacting therewith a) has not been selected, the heald is at a height $3\times h_1$ above its lowest position;

b) has been selected, the heald is at a height $4\times h_1$ above its lowest position.

A disadvantage of this known jacquard machine is that it cannot be converted to a three-position jacquard machine.

Belgian Patent Application No. 529,019 discloses another jacquard machine, the lifter device of which comprises a first and a second lifter element, which elements, as described above, interact with respective complementary hooks. A lifter cord is attached by one end to the first lifter element and is passed in succession over a fixed reversing roller and the bottom lifter roller of the second lifter element, while the other end is connected to a harness cord.

There are four possible positions for the warp threads: when both lifter elements are hanging in their lowest position, when only the first lifter element is hanging in its top position, when only the second lifter element is hanging in its top position, and when both lifter elements are hanging in their top position.

This jacquard machine cannot be converted to a three-position jacquard machine either.

SUMMARY OF THE INVENTION

The object of this invention is to produce a jacquard machine with lifter device having the features from the first paragraph of this description, which jacquard machine is convertible by a single action from a three-position jacquard machine to a four-position jacquard machine, and vice versa, or to a five-position jacquard machine, and vice versa.

This object is achieved by attaching the reversing roller on a first grate, and by attaching the lifter cord by one end to a second grate, while each grate optionally either can be disposed in a fixed position or can be provided in such a way that it can be set in motion up and down in phase with one of the knives. The first grate and the second grate will be called the reversing roller grate and the lifter cord attaching grate respectively below.

If both grates are in a fixed position, then we have a three-position jacquard machine, as explained above.

If only the reversing roller grate is set in motion up and down in phase with one of the knives, we have a four-position jacquard machine or a five-position jacquard machine, as explained below.

We take as the reference height for the lifter cord end (to which one or more harness cords are connected) the height at which said end is situated when none of the hooks of the lifter elements has been selected and when the reversing roller grate is situated in its lowest position. We indicate the lifting height of the knives by $h_1$, while the lifting height of the grate is indicated by $h_2$.

The possible positions of the lifter cord end towards the harness are obtained as follows:

A) If none of the hooks of the two lifter elements has been selected, and said hooks are thus situated in their lowest position, and if the knife which carries along the reversing roller grate
   a) is in its lowest position, then the lifter cord end towards the harness is at reference height: 0;
   b) is in its highest position, then the lifter cord end towards the harness is in the lowest position at the height: $-2\times h_2$.

B) If one of the complementary hooks of one lifter element has been selected and taken by a knife to its highest position, while neither of the two hooks of the other lifter element has been selected (both hooks in their lowest position), and if the knife which is situated in its top position
   a) is the knife which carries along the reversing roller grate, then the lifter cord end towards the harness is situated at the height: $h_1-(2\times h_2)$;
   b) is the knife which does not carry along the reversing roller grate, then the lifter cord end towards the harness is situated at the height: $h_1$.

C) If one of the complementary hooks of the two lifter elements has been selected and taken by a knife to its highest position, and if a knife which is situated in its top position
   a) is a knife which carries along the reversing roller grate, then the lifter cord end towards the harness is situated at the height: $(2\times h_1)-(2\times h_2)$.
   b) is a knife which does not carry along the reversing roller grate, then the lifter cord end towards the harness is situated at the height: $2\times h_1$.

The warp threads can consequently be taken into six different positions at the following heights: $-2\times h_2$; $h_1-(2\times h_2)$; $(2\times h_1)-(2\times h_2)$; 0 (reference position in situation of point A, a) above); $h_1$; $2\times h_1$.

If the jacquard machine is designed in such a way that $h_2=h_1/2$, one obtains a four-position jacquard machine with the following possible positions for the warp threads: $-h_1$; 0; $h_1$; $2\times h_1$.

If the jacquard machine is designed in such a way that $h_2=h_1$, one obtains a five-position jacquard machine with the following possible positions for the warp threads: $-2\times h_1$; $-h_1$; 0; $h_1$; $2\times h_1$.

Therefore, depending on the design, the jacquard machine according to this invention can be converted from a three-position jacquard machine to a four-position jacquard machine, and vice versa, or from a three-position jacquard machine to a five-position jacquard machine, and vice versa.

The reversing roller grate can also be disposed in a fixed position, and only the lifter cord attaching grate can be set in motion up and down in phase with one of the knives. If $h_1=h_3$, a four-position jacquard machine is obtained, and if $h_3=2\times h_1$, a five-position jacquard machine is obtained.

If both grates are set in motion up and down in phase with one of the knives, and the same knife is taken for this (a different knife can also be taken) a four-position jacquard machine or a five-position jacquard machine can be obtained in a different way, as explained below.

The lifting height of the lifter cord attaching grate is indicated by $h_3$, at the time when the knife which is carrying along said grate is in its highest position. The reference height for the lifter cord end at the harness side is the same as was assumed above.

A) If none of the hooks of the two lifter elements has been selected, and said hooks are thus situated in their lowest position, and if the knife which carries along the lifter cord attaching grate
   a) is situated in its lowest position, the lifter cord end at the harness side is at the reference height: 0;
   b) is situated in its highest position, the lifter cord end at the harness side is in the lowest position, at the height: $(-2\times h_2)-h_3$.

B) If one of the complementary hooks of one lifter element has been selected and has been taken by a knife to its highest position, while neither of the two hooks of the other lifter element has been selected (both hooks in their lowest position), and if the knife which is situated in its top position
   a) is the knife which carries along the lifter cord attaching grate, then the lifter cord end at the harness side is situated at the height: $h_1-(2\times h_2)-h_3$;
   b) is the knife which does not carry along the the lifter cord attaching grate, then the lifter cord end at the harness side is situated at the height: $h_1$.

C) If one of the complementary hooks of the two lifter elements has been selected and has been carried along the knife to its highest position, and if a knife which is situated in its top position
   a) is a knife which carries along the lifter cord attaching grate, then the lifter cord end at the harness side is situated at the height: $(2\times h_1)-(2\times h_2)-h_3$;

b) is a knife which does not carry along the lifter cord attaching grate, then the lifter cord end at the harness side is situated at the height: $2\times h_1$.

The warp threads can consequently be taken into six different positions at the following heights: $(-2\times h_2)-h_3$; $h_1-(2\times h_2)-h_3$; $(2\times h_1)-(2\times h_2)-h_3$; 0; $h_1$; $2\times h_1$.

If the jacquard machine is designed in such a way that $h_2=h_3=h_1/3$, one obtains a four-position jacquard machine with the following possible positions for the warp threads: $-h_1$; 0; $h_1$; $2\times h_1$.

If the jacquard machine is designed in such a way that $h_2=h_3$, one obtains a five-position jacquard machine with the following possible positions for the warp threads: $-2\times h_1$; $-h_1$; 0; $h_1$; $2\times h_1$.

In this way also, the jacquard machine, depending on its design ($h_2=H_3=h_1/3$ or $h_2=h_3=(2\times h_1)/3$), can thus be converted from a three-position jacquard machine to a four-position jacquard machine, and vice versa, or from a three-position jacquard machine to a five-position jacquard machine, and vice versa.

In a special embodiment according to this invention the ratio between the lifting height ($h_1$) of one of the knives and the lifting height ($h_1$), ($h_3$) of each grate connected to said knife is adjustable.

This means that it is possible to determine the height of the various possible positions for the warp threads by adjusting the jacquard machine. Besides, through selection of certain values for the abovementioned ratio (see above) it is possible also to convert the jacquard machine from a four-position jacquard machine to a five-position jacquard machine, and vice versa.

A specific embodiment is provided with disconnectable connecting means, in order to connect each grate to an element which is set in motion up and down in phase with one of the knives, said connecting means comprising a reduction mechanism by means of which the abovementioned ratio can be adjusted.

A connection of the grate to the abovementioned element is the simplest way of setting the grate in motion up and down in phase with one of the knives. Due to the fact that said connection is disconnectable, the grate is easily and quickly detached from or connected to said element. The reduction mechanism is also a simple means for allowing the abovementioned ratio to be adjusted by a simple action.

The reduction mechanism is preferably a lever having a fixed hinge point, which lever is provided for connection to a grate at at least two different distances from the hinge point. The abovementioned element is also connected to said lever. This means that at least two different values can be set for the above ratio.

According to a specific embodiment, the abovementioned element is a knife grate to which four bars are attached, each of which is hingedly attached to the end of a lever, the other end of which is hingedly connected to a fixed part of the device.

In a preferred embodiment of this invention the lever is provided for connection to a grate at four different distances away from the hinge point, while the ratio between these respective distances, on the one hand, and the distance between the fixed hinge point and the position of attachment of the element to the lever, on the other hand, is ⅓, ½, ⅔ and 1 respectively.

This means that the ratios $h_1/h_2$ and $h_1h_3$ can be set at one of the following values: 1; 3/2; 2; 3.

With the ratio $h_1/h_2=2$, thus $h_2=h_1/2$ (with the second grate fixed), a four-position jacquard machine is obtained, as described above.

With the ratio $h_1/h_2=1$, thus $h_2=h_1$ (with the second grate fixed), a five-postion jacquard machine is obtained, as described above.

With the ratio $h_1/h_2=h_1/h_3=3$, thus $h_2=h_3=h_1/3$, a four-postion jacquard machine is obtained, as described above.

With the ratio $h_1/h_2=h_1/h_3=3/2$, thus $h_2=j_3=(2\times h_1)/3$, a five-position jacquard machine is obtained, as described above.

In another preferred embodiment of this invention the first grate is provided for connection optionally either to the abovementioned lever or to a fixed part of the device, while the second grate is provided for connection optionally either to the first grate or to a fixed part of the device. This means that only one connection to the lever is required in order to set both grates in motion up and down in phase with a knife.

In yet another preferred embodiment of this invention at least one connecting element with two angle-forming legs is attached to the second grate, said connecting element being rotatable about an axis which crosses the connecting element in the vicinity of its corner, while the connecting element optionally can be attached by one leg to the first grate and by the other leg to the fixed part, or by one leg to the first grate, or by one leg to the fixed part.

With such a connecting element the two grates can very easily and quickly be taken from the fixed arrangement into the arrangement for being carried along by a knife, or vice versa.

In order to obtain a progressive shed formation, it is known to dispose the reversing roller grate in the direction at right angles to the grate bars, at a certain inclination. In the case of the jacquard machine known from EP-0,399,930 the shafts of the reversing rollers are consequently given the same inclination, while the lifter cords extend vertically upwards from each reversing roller. This produces bending stresses in the shafts of the reversing rollers and torsion in the bars of the grates.

This problem is solved by according to the invention disposing the reversing roller hingedly. This also prevents rotational oscillations, which is the case, inter alia, with the jacquard machine known from BE-529,019.

By in this case providing a hinge which permits rotation of the reversing roller only about an axis extending virtually horizontally, the abovementioned problem and also the rotational oscillations are prevented in a very effective way. Rotational oscillations are often the reason why the various parts of the lifter cord extending next to each other become entangled.

In the case of the jacquard machine with lifter device known from EP-0,399,930 the shaft of the reversing roller is fixed at one side. This means that said shaft is subject to a relatively high bending stress, which often results in a bending of the shaft. The roller consequently goes into an obliqe position, and the lifter cord jumps out of the roller groove.

This problem also is solved by fixing the shaft of the reversing roller at both sides.

In another special embodiment according to this invention the lifter device is provided in such a way that the working face of the reversing roller extends diagonally relative to the working faces of two adjacent lifter element rollers over which the lifter cord is passed.

This means that the diameter of the reversing roller can be greater for a certain distance between the first and second lifter elements. The lifter cord is consequently bent with a greater radius of curvature, with the result that a longer service life of the lifter cord is obtained.

According to a specific embodiment, the lifter device comprises two sets of first and second lifter elements, while the reversing roller interacting with one set of lifter elements is attached on the first grate, and the reversing roller interacting with the other set of lifter elements is attached on a third grate; and the first and the third grate can be set in motion up and down in phase with one knife and in phase with the other knife respectively. Weaves with pile warp threads moving in counterphase can be woven with such a jacquard machine.

The movement of the third grate in counterphase with the first grate can be obtained through the first grate being connected to an element which is set in motion up and down in phase with one of the knives, while the third grate is connected to the same element by way of a reversing mechanism, and can also be obtained through the third grate being connected to an element which can be set in motion up and down in phase with the other knife.

According to a preferred embodiment, each lifter element interacts with two hooks which can be carried along by a different knife and are connected to each other by a cord, while each lifter element comprises a top and a bottom lifter roller, and the cord is passed under the top lifter roller, while the lifter cord is passed over the bottom lifter roller.

According to another preferred embodiment, each lifter element is suspended from one hook, which can be selected for retention at one of two different heights.

The features of the jacquard machine with lifter device according to this invention are illustrated with reference to the detailed description which follows of a possible embodiment thereof. In this description reference is made to the appended drawings, in which:

DETAILED DESCRIPTION OF THE PREFERRED EMBODIMENT

Figure 1:
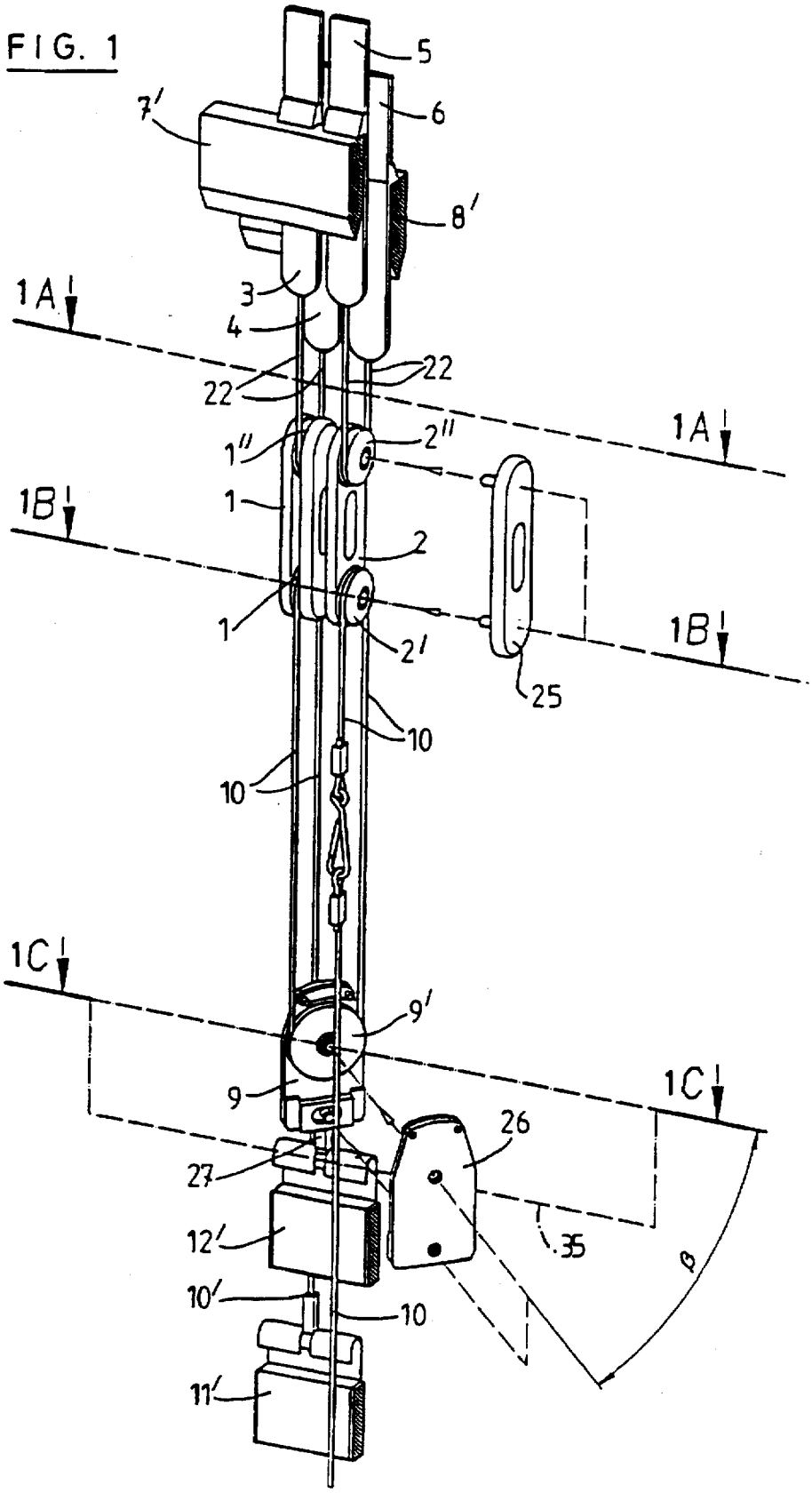
FIG. 1 shows in perspective a lifter device of an electronic jacquard machine.
Figure 1A:
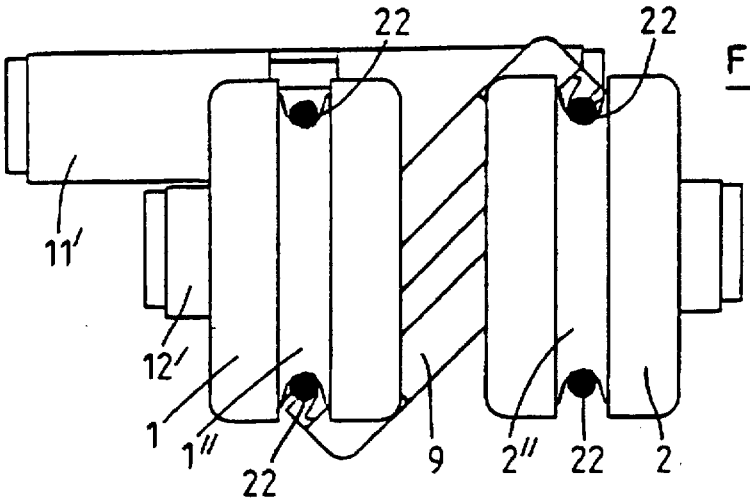
FIGS. 1A, 1B and 1C show cross-sections of the lifter device of FIG. 1, along the lines AA, BB and CC respectively.
Figure 1B:
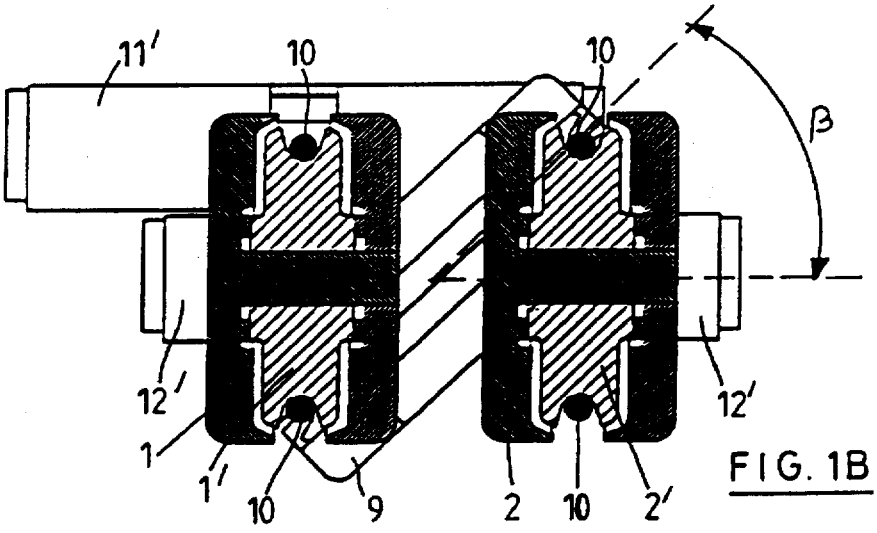
Figure 1C:
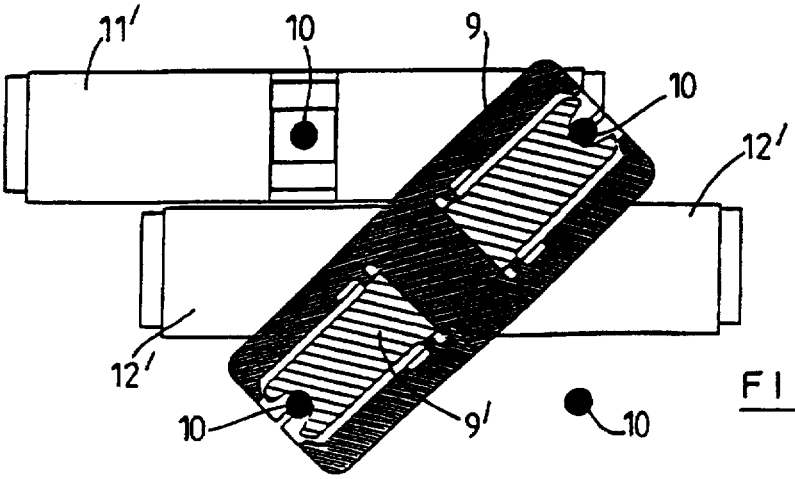

The lifter device of a jacquard machine according to this invention (see FIGS. 1, 1A, 1B, 1C) comprises a first (1) and a second lifter element (2), provided respectively with a top lifter roller (1"), (2") and a bottom lifter roller (1'), (2'). The lifter rollers (1', 1"), (2', 2") of each lifter element (1), (2) are disposed rotatably between flank plates (25). In FIG. 1 a flank plate (25) of the second lifter element (2) has been taken away.

The lifter elements (1), (2) can also be designed in such a way that the bottom lifter roller (1'), (2') is situated in a plane which forms an angle with the plane in which the top lifter roller (1"), (2") is situated.

Each lifter element (1), (2) is suspended with the top lifter roller (1"), (2") in the downward hanging loop of a cord (22) which connects two complementary hooks (3, 4), (5, 6). Each hook (3, 4), (5, 6) can be selected by known selection means (not shown in the figures) to be carried along by a knife (7'), (8'). One hook (3), (5) of two complementary hooks (3, 4), (5, 6) can be carried along by one knife (7'), while the other hook (4), (6) can be carried along by the other knife (8').

The two knives (7'), (8') are connected to drive means (not shown in the figures), with the result that they can be set in motion up and down in counterphase with each other.

A hook (3, 4), (5, 6) which has not been selected is not carried along and remains supported in its lowest position by known means which are not shown in the figures.

Disposed below these lifter elements (1), (2) is a first grate (12), which is provided with grate bars (12'), as can be seen in FIGS. 2 to 6. This grate is known as the reversing roller grate. Attached on a grate bar (12') extending below the lifter elements (1), (2) is a reversing roller element (9), comprising two flank plates (26), between which a reversing roller (9') is rotatably attached on a shaft which is fixed at both sides. A flank plate (26) of the reversing roller element (9) has been taken away in FIG. 1.

The reversing roller element (9) is hingedly attached on the grate bar (12') by means of a short rigid stem (27). The reversing roller element (9) is thus hingedly disposed so that it pivots about an axis (35) which lies in the lengthwise direction of the grate bar (12'). Said hinge point does permit rotation in a plane at right angles to the direction of the grate bar, but prevents rotation about a vertical axis. The reversing roller element (9) is attached on a short rigid stem (27).

Disposed below the first grate (12) is a second grate (11), which is provided with grate bars (11'), as can be seen in FIGS. 2 to 6. This grate is known as the lifter cord attaching grate.

One end (10') of a lifter cord (10) is attached to a grate bar (11') extending below the lifter elements (1), (2). The lifter cord (10) extends upwards from said end (10'), is passed over the bottom lifter roller (1') of the first lifter element (1), then runs downwards, where it is passed under the reversing roller (9'), runs back upwards, where it is passed over the bottom lifter roller (2') of the second lifter element (2), and runs back down, where the other end is connected to one or more harness cords (not shown in the figures) for lifting at least one warp thread.

Due to the fact that the lifter cord (10) comes from the first lifter element (1) before it is passed over the reversing roller (9') and then runs to the second lifter element (2), the reversing roller element (9) assumes a position in which the reversing roller (9') is situated in a plane lying at an angle relative to the planes in which the lifter rollers (1'), (2') are situated. This can be seen most clearly in FIG. 1B. As indicated in FIG. 1, the shaft of the reversing roller (9') extends in a direction which forms an angle ($\beta$) with the direction in which the grate bar (12') extends.

Figure 7:
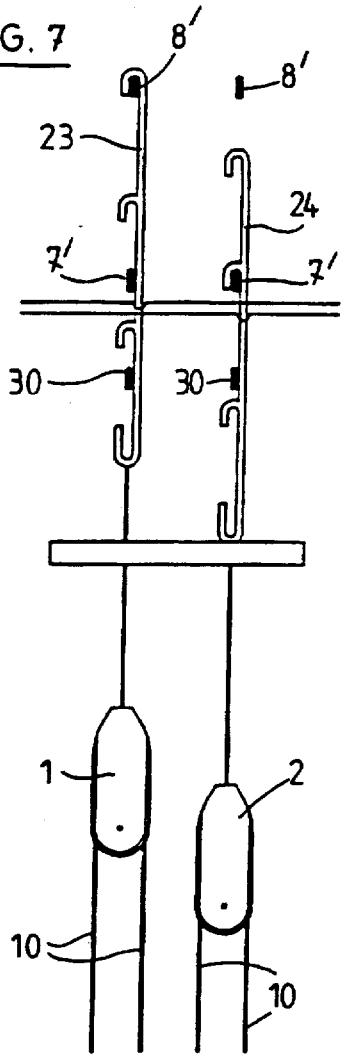
FIG. 7 shows a side view of two lifter elements of a mechanical jacquard machine which are suspended from one hook.
Figure 8:
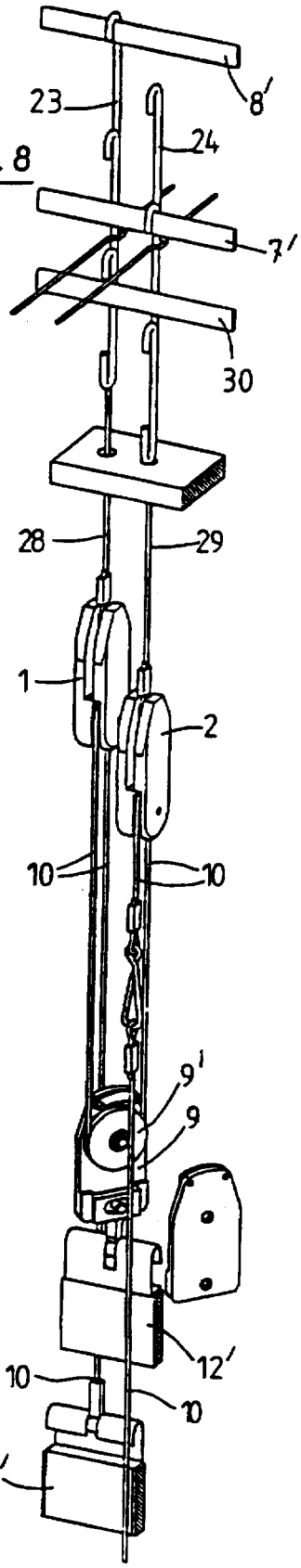
FIG. 8 shows in perspective a lifter device of a mechanical jacquard machine in which each lifter element is suspended from one hook.

A lifter device of a mechanical jacquard machine, in which each lifter element (1), (2) interacts with one hook (23), (24) differs from the lifter device described above (see FIGS. 7 and 8) only through the fact that each lifter element (1), (2) has only one lifter roller (over which the lifter cord (10) is passed), and through the fact that each lifter element (1), (2) is suspended by means of a cord (28), (29), from one hook (23), (24). Through the use of known selection means, each hook (23), (24) remains in its highest or lowest position through or can be set in motion up and down by a knife (7'), (8'), or can remain in its highest position. A hook (23), (24) remains in its highest or lowest position through the fact that it is hooked on a grate bar (30) of a locking grate at a height corresponding to that position.

The way in which six, in particular four or five, different positions can be obtained for the warp threads is the same as that which was described for lifter elements which interact with two complementary hooks.

In this case the situation in which no complementary hook (3, 4), (5, 6) at all has been selected (situation A above) corresponds to the situation in which the single hook (23), (24) of each lifter element (1), (2) is in its lowest position.

The situation in which one complementary hook (3, 4), (5, 6) of one lifter element (1), (2) has been selected (situation B) corresponds to the situation in which the single hook (23), (24) of one lifter element (1), (2) has been taken into its highest position.

The situation in which one complementary hook (3, 4), (5, 6) of both lifter elements (1), (2) has been selected corresponds to the situation in which the single hook (23), (24) of both lifter elements (1), (2) has been taken into its highest position.

Thus the various situations A,a; A,b; B,a B,b; C,a; C,b; can occur in a similar way, but for the same lifting height ($h_1$) of the knives (7', 8') the lifting height of a lifter element (1), (2)

is $h_1/2$ in the case of the arrangement with two complementary hooks (3, 4), (5, 6) per lifter element (1), (2);

is $h_1$ in the case of the arrangement with a single hook (23), (24) per lifter element (1), (2).

If only the first grate (12) can be carried along by a knife (7', 8'), the six different positions for the warp threads are consequently:

$-2\times h_2$; $(2\times h_1)-(2\times h_2)$; $(4\times h_1)-(2\times h_2)$; 0; $2\times h_1$; $4\times h_1$.

If $h_2=h_1$, those positions are: $-2\times h_1$; 0; $2\times h_1$; $4\times h_1$, so that a four-position jacquard machine is obtained.

If $h_2=2\times h_1$, those positions are: $-4\times h_1$; $2\times h_1$; 0; $2\times h_1$; $4\times h_1$, so that a five-position jacquard machine is obtained.

The six different positions for the warp threads if both grates (11), (12) can be carried along by the same knife are: $(-2\times h_2)-h_3$; $(2\times h_1)-(2\times h_2)-h_3$; $(4\times h_1)-(2\times h_2)-h_3$; 0; $2\times h_1$; $4\times h_1$.

If $h_2=h_3=(2\times h_1)/3$, those positions are: $-2\times h_1$; 0; $2\times h_1$; $4\times h_1$, so that a four-position jacquard machine is obtained.

If $h_2=h_3=(4\times h_1)/3$, those positions are: $-4\times h_1$; $-2\times h_1$; 0; $2\times h_1$; $4\times h_1$: so that a five position jacquard machine is obtained.

Figure 9:
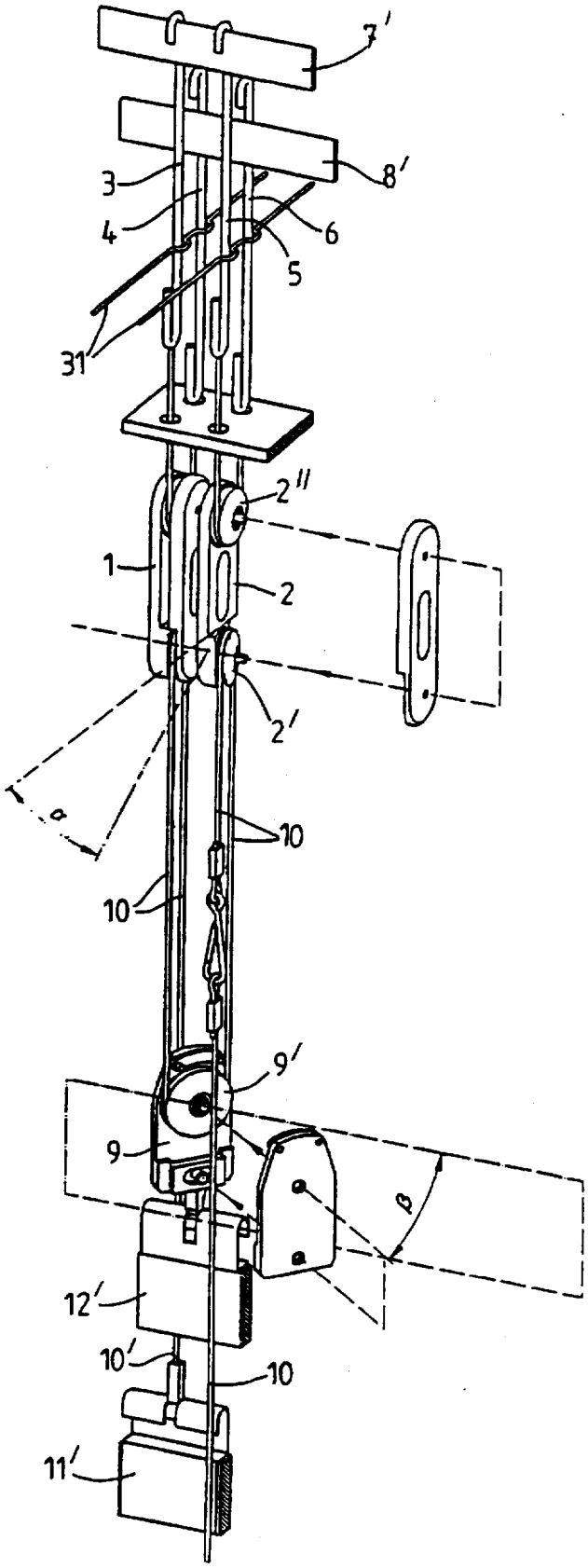
FIG. 9 shows in perspective a lifter device of a mechanical jacquard machine in which each lifter element is suspended from two complementary hooks.

A lifter device of a mechanical jacquard machine, in which each lifter element (1), (2) interacts with two complementary hooks (3, 4), (5, 6), as shown in FIG. 9, is identical to a lifter device for an electronic jacquard machine, as shown in FIG 1, apart from the fact that the hooks (3, 4), (5, 6) are designed differently, and are selectable by mechanical means (31).

The essential parts of an electronic jacquard machine which is optionally convertible to a three-position, a four-position or a five-position jacquard machine are shown in FIGS. 2 to 6, which show the various possible arrangements respectively.

This jacquard machine (see FIG. 2) comprises two knife grates (7), (8), which are provided respectively with a series of horizontally extending knives (7'), (8'). The knife grates (7), (8) are connected to means (not shown) for setting them in motion up and down in counterphase with each other. For the sake of clarity of the drawings, only three knives (7'), (8') are shown in FIGS. 2 to 6.

Four bars (15) are hingedly attached by their one end to one (7') of the two knife grates (7'), (8'). These bars (15) are attached in pairs on the grate elements extending at right angles to the knives (7'), (8') and bearing the knives (7'), (8'), and extend downwards, while their other end is hingedly attached to the end of a lever (16). Said hinge point is indicated by reference number (19). Each of said four levers (16) is hingedly connected by the other end in a hinge point (16') to a fixed part (17) of the jacquard machine or of the weaving loom with which the jacquard machine interacts. Each lever (16) is provided with four bores, at a distance L/3, L/2; 2L/3 and L away from the hinge point (16') where the end of the lever (16) is hingedly attached to the fixed part (17), and L is the distance between the two hinge points (16'), (19) of the lever (16) concerned.

Provided above one another below the knife grates (7), (8) are a first grate (12) and a second grate (11), which are provided with horizontally extending grate bars (12'), (11') respectively, running parallel to the knives (7'), (8').

Four connecting elements (13) are attached to the second grate (11), which is situated vertically below the first grate (12). Each connecting element (13) comprises essentially two angle-forming legs (13"), (13'") and is rotatably attached on a shaft (13'), which crosses the connecting element (13) in the vicinity of its corner, while said shaft is attached horizontally on the grate (11). The four connecting elements (13) are attached in pairs on the edges of the grate (11) extending at right angles to the grate bars (11'), in the vicinity of each corner of the grate (11).

Each connecting element (13) is in such a position (in FIG. 2) that one leg (13'") extends vertically upwards, while the other leg (12') extends horizontally past an edge extending parallel to the grate bars (11'). One leg (13'") is attached to the first grate (12), while the other leg (13") is attached to a fixed part (14) of the jacquard machine or of the weaving loom with which said jacquard machine interacts.

For each set of two knives (7'), (8'), which can be driven so that they move up and down in counterphase, the jacquard machine also comprises a series of lifter devices, consisting of two lifter elements (1), (2), two complementary hooks (3, 4), (5, 6) per lifter element (1), (2), a cord (22), a lifter cord (10) and a reversing roller element (9) which, as described above (see FIG. 1) are disposed so that they interact with said knives (7'), (8') and with the grates (12), (11). For the sake of clarity, only a limited number of lifter devices have been shown in FIG. 2 to 6.

Figure 2:
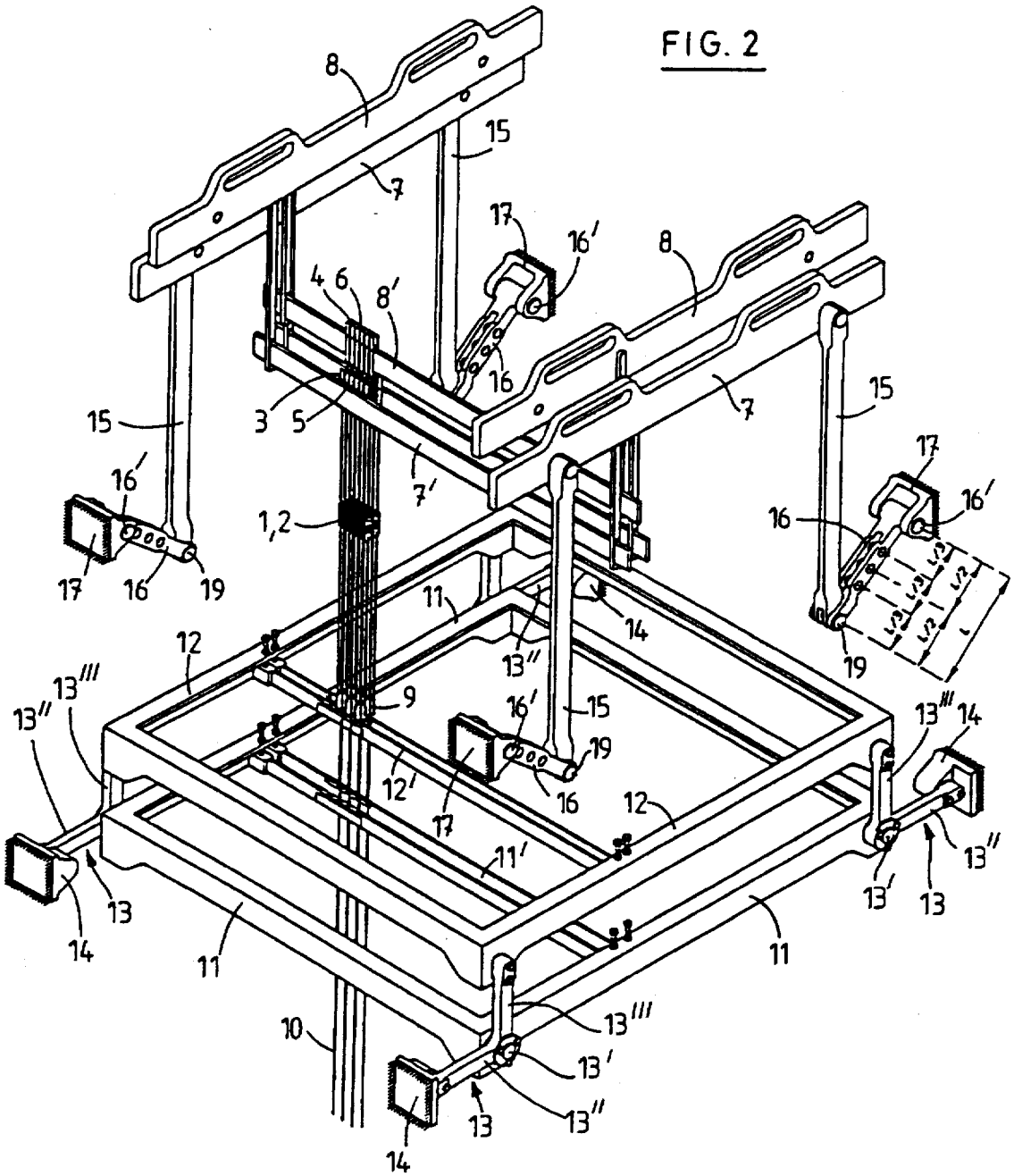
FIG. 2 shows a perspective an electronic jacquard machine according to this invention, disposed in a fixed position in the arrangement with two grates, so that a three-position jacquard machine is obtained.

In the arrangement of FIG. 2 the jacquard machine is a three-position jacquard machine, because the two grates are disposed in a fixed position.

Figure 3:
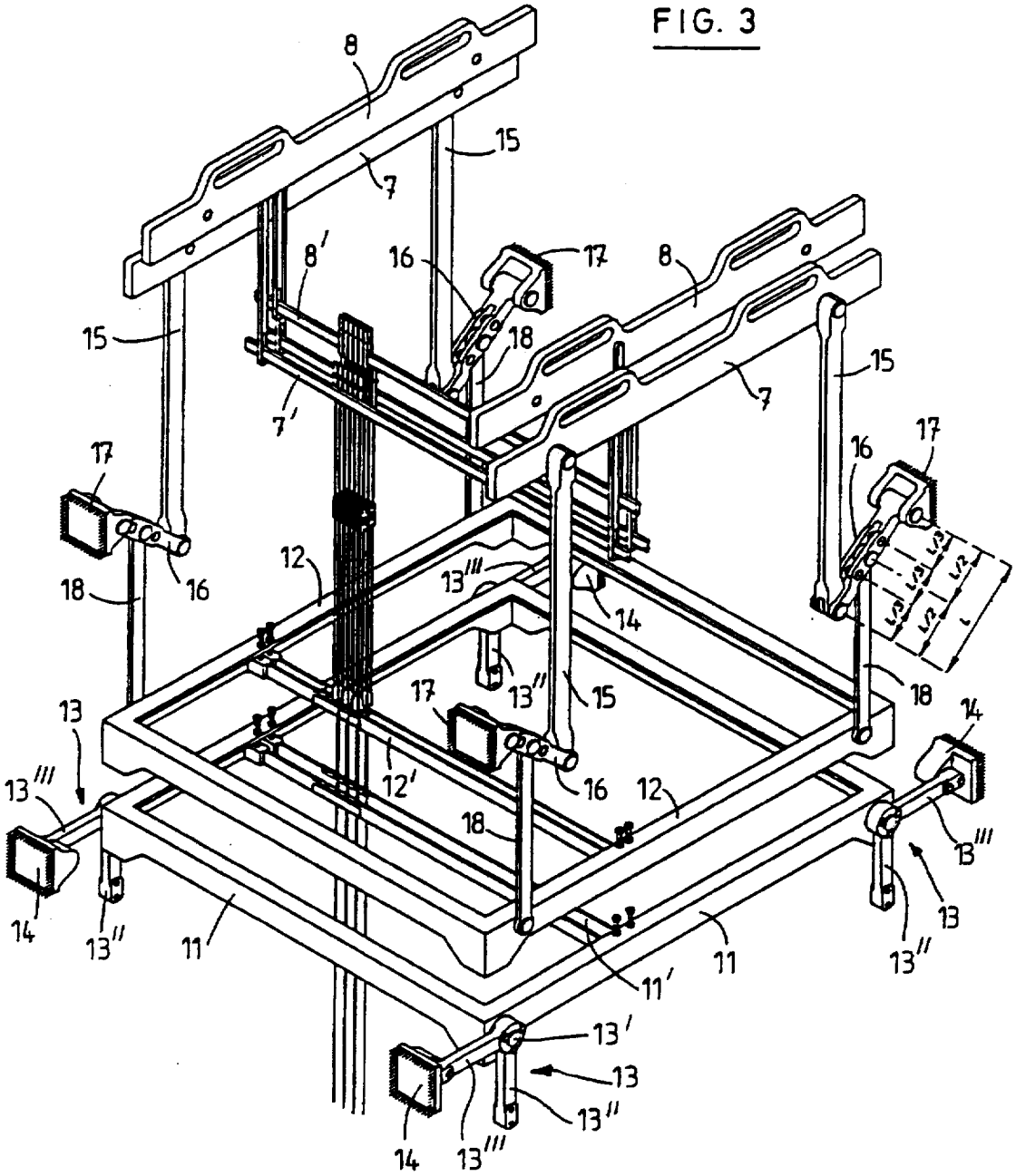
FIG. 3 shows the arrangement in which the first grate moves along with a knife at a ratio of $h_1/h_2=2$, and the second grate is disposed in a fixed position, so that a four-position jacquard machine is obtained.

In the arrangement of FIG. 3 four bars (18) are hingedly attached by their one end to the first grate (12). Said bars (18) are attached in pairs on the edges of the grate (12) extending at right angles to the direction of the grate bars (12'), and extend upwards. The other end of each bar (18) is hingedly attached to the lever (16) situated above it, by means of a pin in the bore at a distance L/2 away from the hinge point (16') of said lever (16).

The second grate (11) is attached by the connecting element (13) to said fixed part (14). The jacquard machine is therefore in the arrangement in which only the first grate (12) moves along in phase with one (7') of the knives (7'), (8'), while $h_2=h_1/2$. As explained above, a four-position jacquard machine is obtained in this way, with the following lifting heights for the warp threads; $-h_1$; 0; $h_1$; $2\times h_1$.

Figure 4:
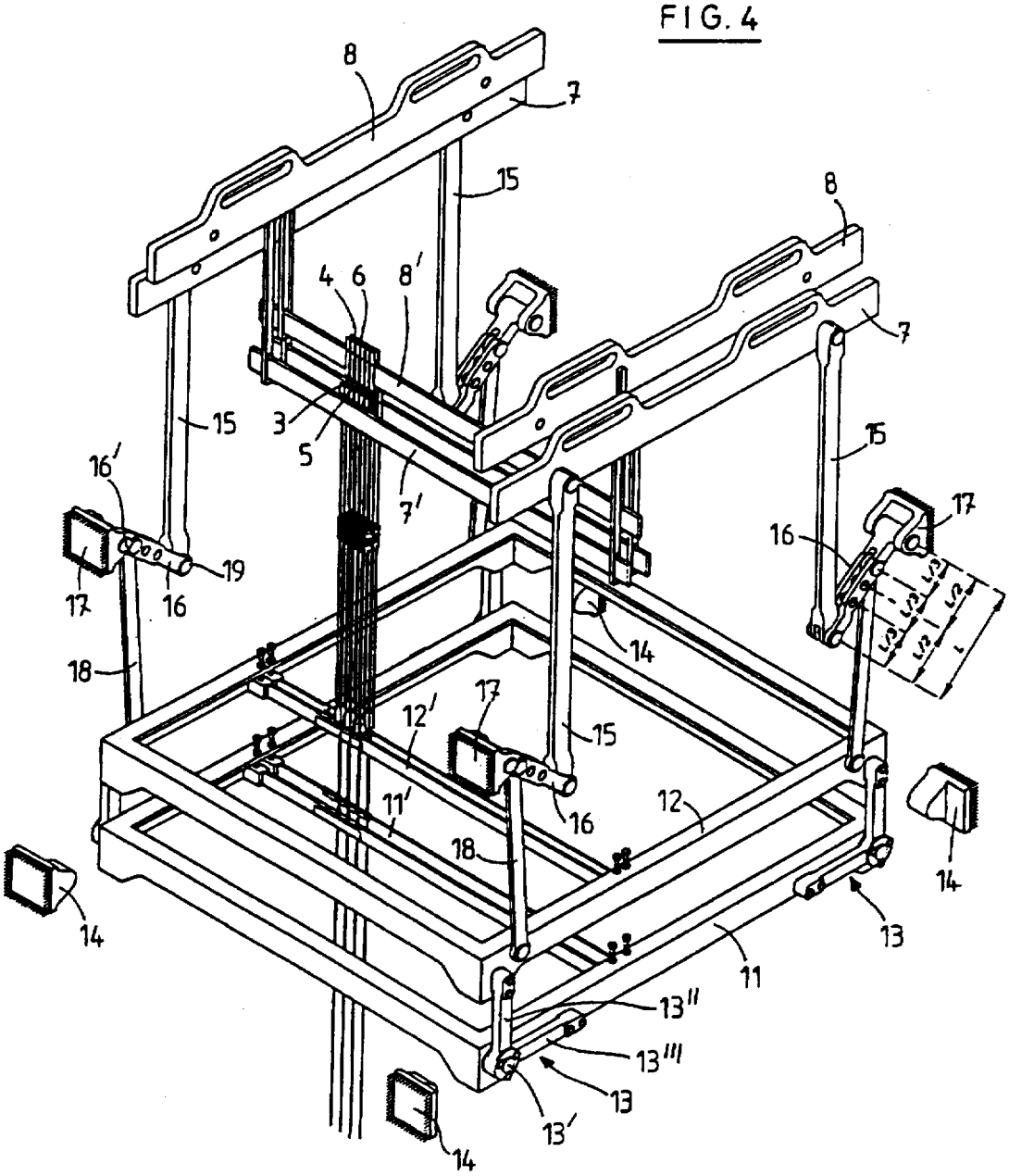
FIG. 4. shows the arrangement in which both grates move along with a knife at a ratio of $h_1/h_2=3$, so that a four-position jacquard machine is obtained.

In the arrangement of FIG. 4 the bars (18) are hingedly attached to the respective levers (16) at a distance L/3 away from the hinge point (16'), while the second grate (11) is attached by the connecting element (13) to the first grate (11).

The jacquard machine is therefore in the arrangement in which both grates (11), (12) move along in phase with one (7') of the knives (7'), (8'), while $h_2=h_3=h_1/3$. As explained above, a four-position jacquard machine is consequently obtained in a different way, with the following lifting heights for the pile warp threads: $-h_1$; 0; $h_1$; $2\times h_1$.

Figure 5:
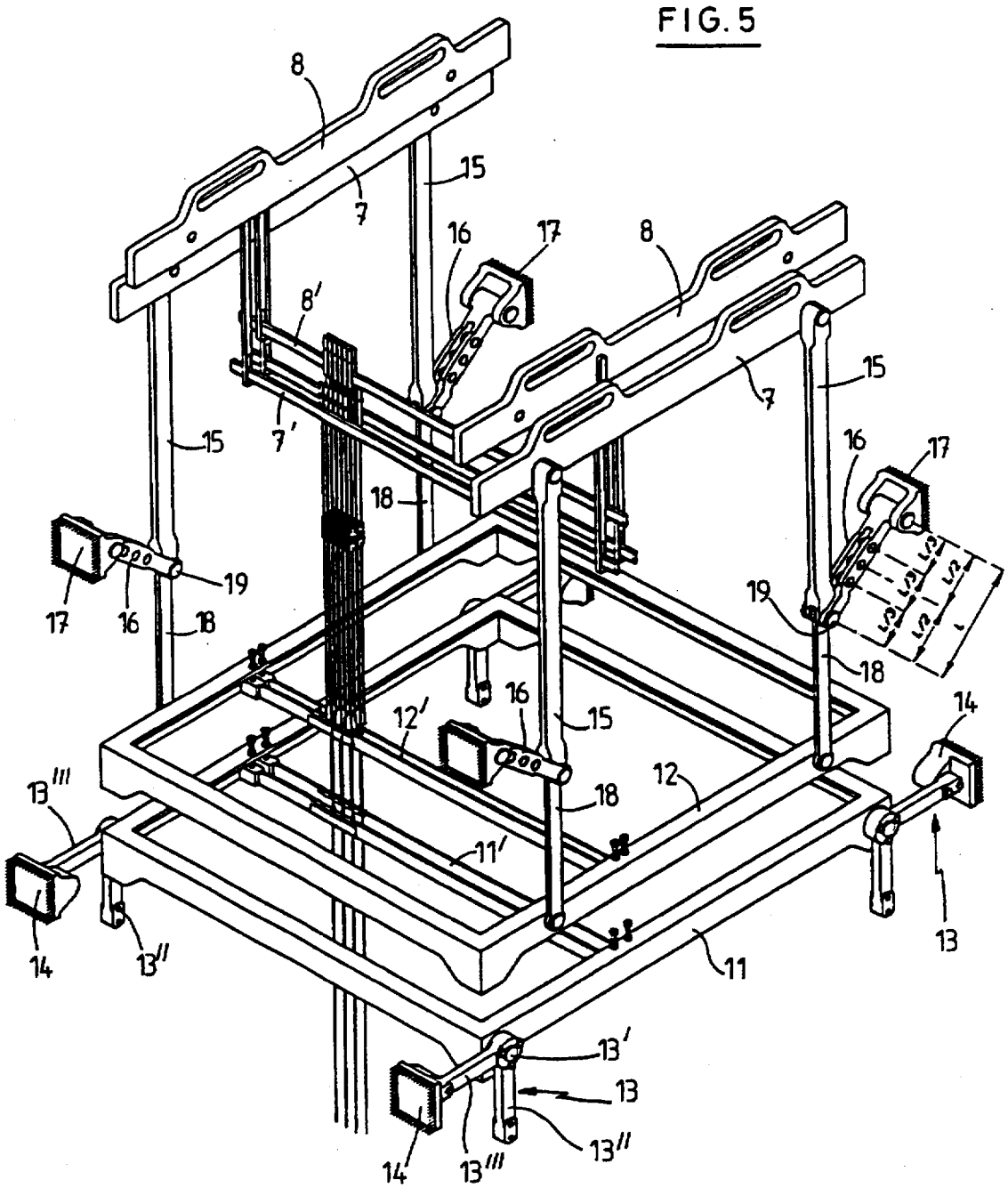
FIG. 5 shows the arrangement in which the first grates moves along with a knife at a ratio of $h_1/h_2=1$, and the second grate is disposed in a fixed position, so that a five-position jacquard machine is obtained.

In the arrangement of FIG. 5 the bars (18) are hingedly attached to the respective levers (16) at a distance L away from the hinge point (16'), while the second grate (11) is attached by the connecting element (13) to the fixed part (14) of the jacquard machine or the weaving loom.

The jacquard machine is therefore in the arrangement in which only the first grate moves along in phase with one (7') of the knives, while $h_2=h_1$. As explained above, a five-position jacquard machine is consequently obtained, with the following lifting heights for the pile warp threads: $-2\times h_1$; $h_1$; 0; $h_1$; $2\times h_1$.

Figure 6:
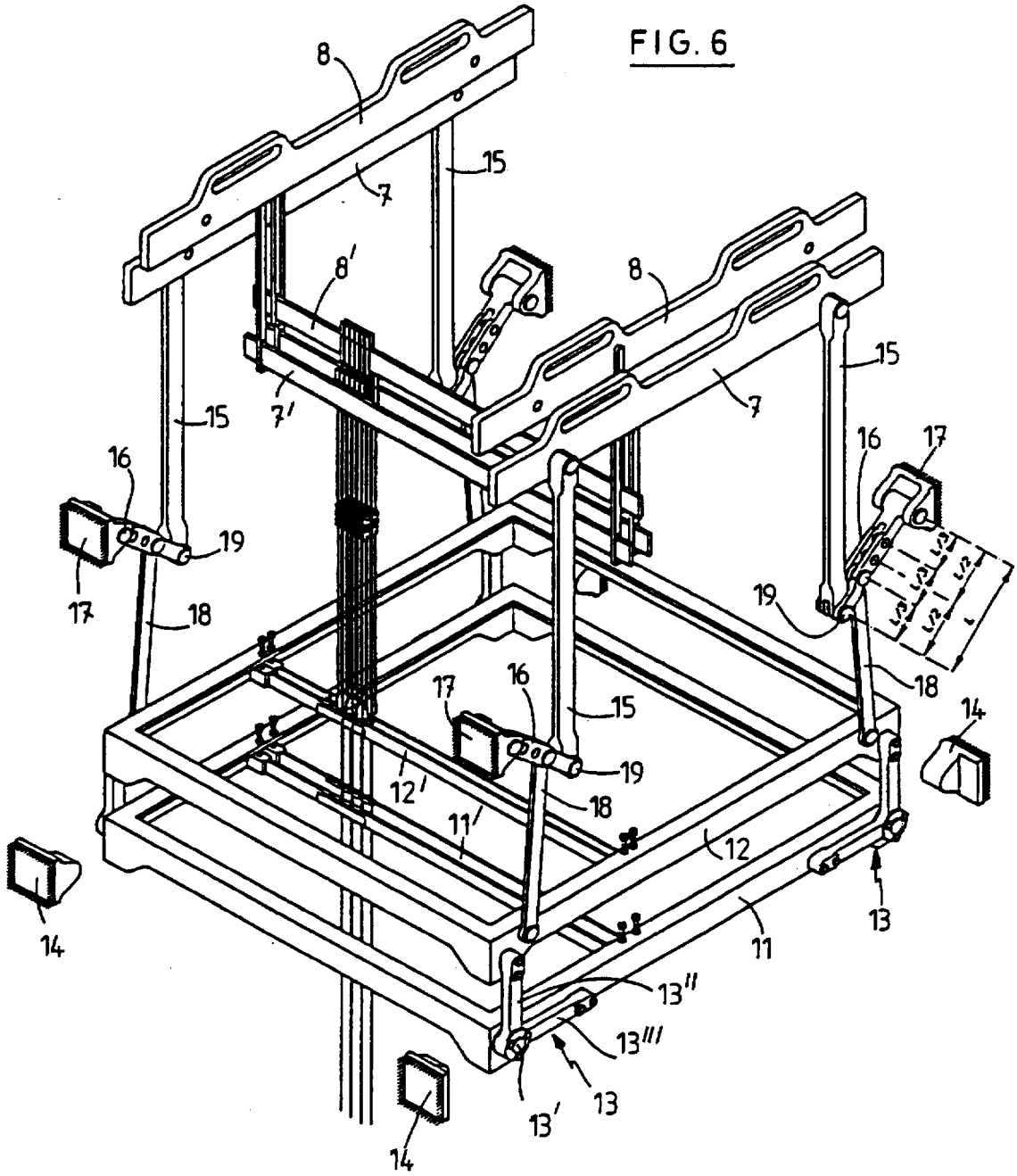
FIG. 6 shows the arrangement in which both grates move along with a knife at a ratio of $h_1/h_2=3/2$, so that a five-position jacquard machine is obtained.

In the arrangement of FIG. 6 the bars (18) are hingedly attached to the respective levers (16) at a distance $(2\times L)/3$ away from the hinge point (16'), while the second grate (11) is attached by the connecting element (13) to the first grate (12).

The jacquard machine is therefore in the arrangement in which both grates (11), (12) move along in phase with one of the knives (7'), (8'), while $h_2=h_3=(2\times h_1)/3$. As explained above, a five-position jacquard machine is consequently obtained in a different way, with the following lifting heights for the pile warp threads: $-2\times h_1$; $-h_1$; 0; $h_1$; $2\times h_1$.

The jacquard machine can be provided with an additional, third grate (20), on which reversing rollers are disposed, while said third grate is provided in such a way that it can be set in motion up and down in counterphase with the first grate (12) with reversing rollers (9).

Figure 10:
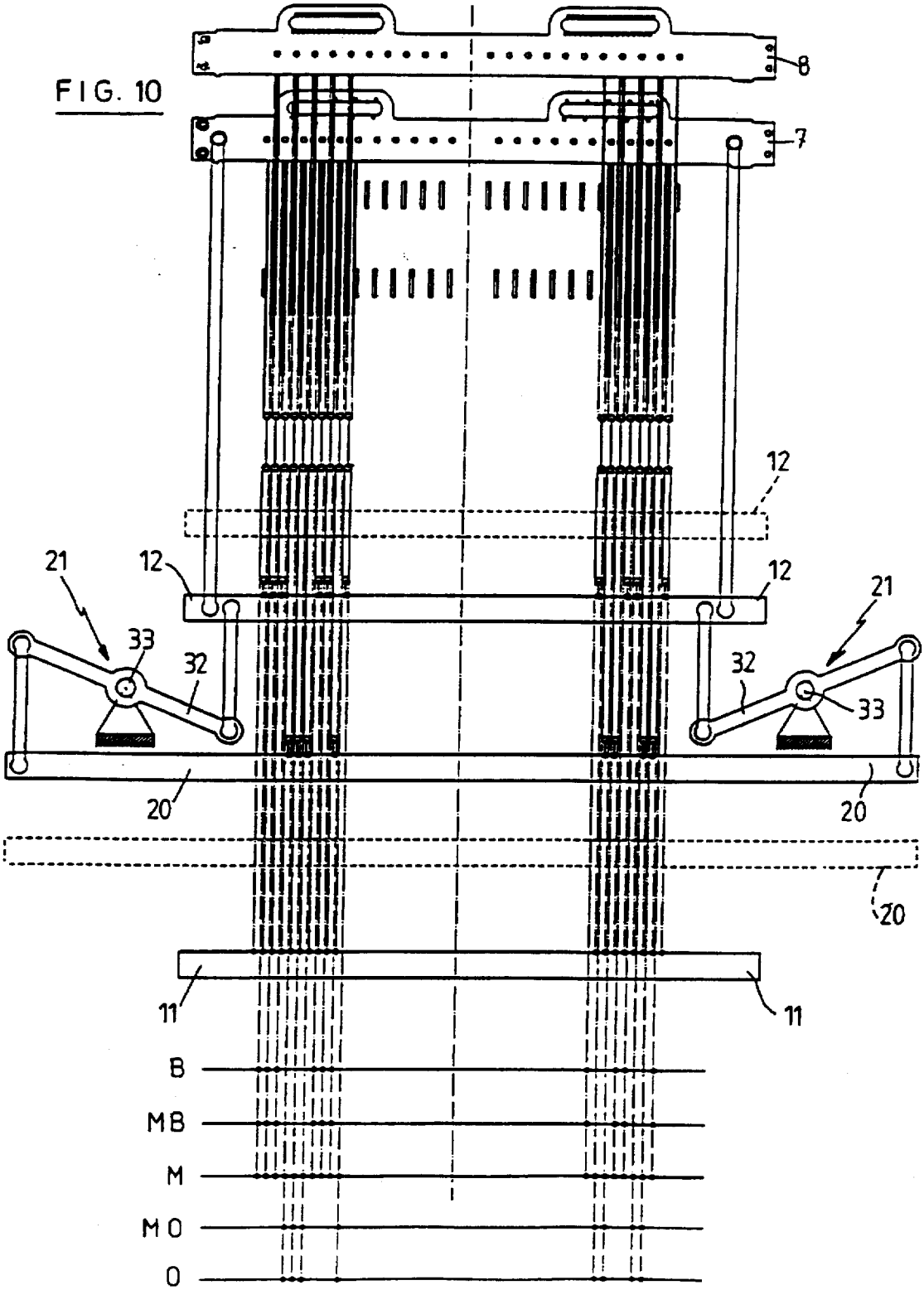
FIG. 10 shows a diagrammatic view of a jacquard machine in which a second and a third grate are provided for moving in counterphase by means of a reversing mechanism.
Figure 11:
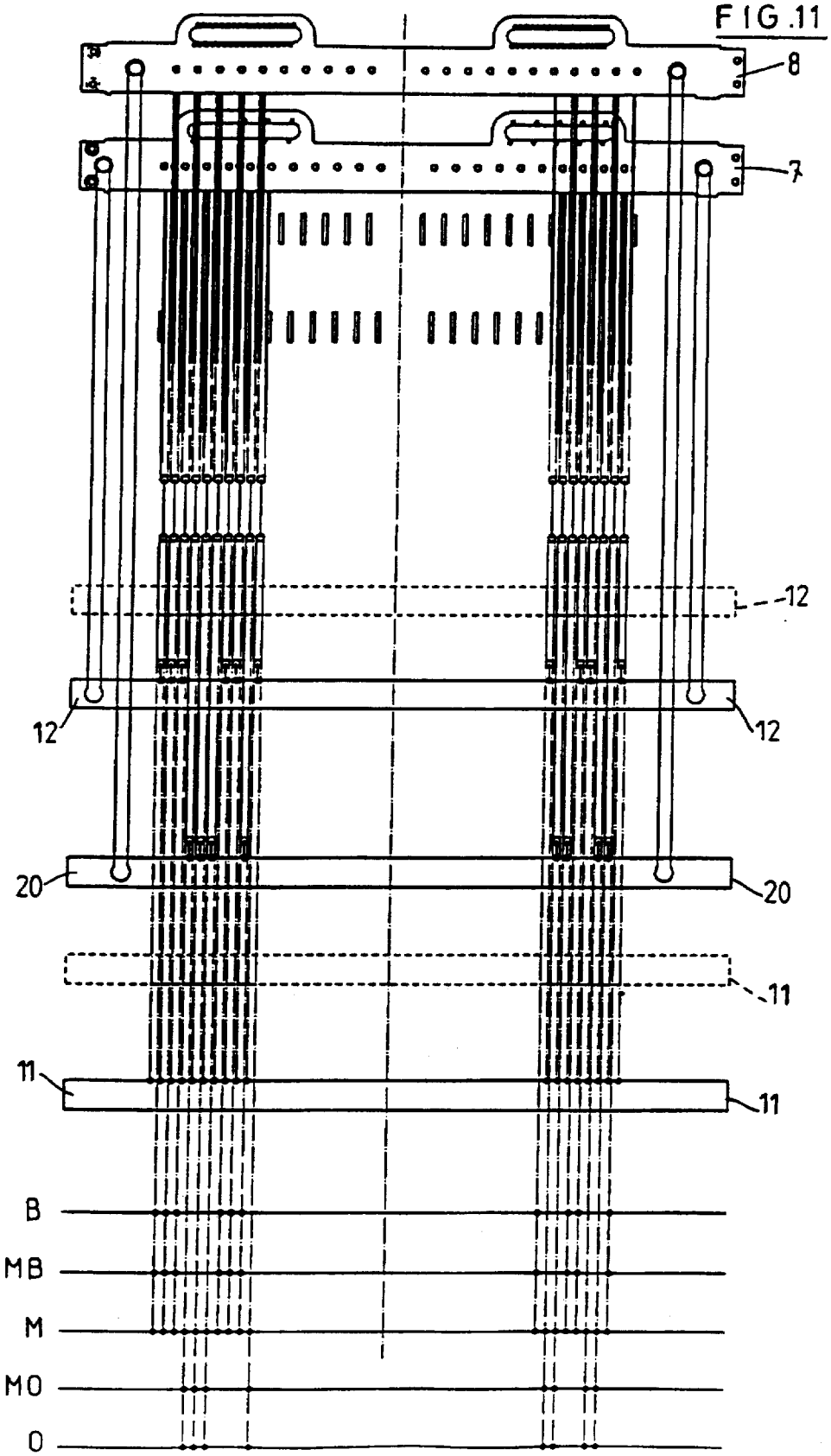
FIG. 11 shows a diagrammatic view of a jacquard machine in which a second and a third grate are provided for moving in counterphase by means of their connection with a different knife.

This movement of the third grate (20)—in counterphase with the first grate (12)—is achieved by connecting (see FIG. 10) the third grate (20) by way of a reversing mechanism (21) to the first grate (12). Said reversing mechanism (21) comprises a lever (32) which has a fixed hinge point (33) in the centre. One end of the lever (32) is connected to the first grate (12), while the other end of the lever (32) is connected to the third grate (20). An upward and downward movement of the first grate (12) give rise to a downward and upward movement respectively of the third grate (20). In FIGS. 10 and 11 the positions of the grates (12), (20) at the moment when the first grate (12) is in its lowest position are shown by solid lines, while the positions of the grates (12), (20) at the moment when the first grate (12) is in its highest position are shown by dashed lines. The second grate (11) is in a fixed position.

The movement of the third grate (20)—in counterphase with the first grate (12)—can also be achieved by connecting both grates (12), (20) to a different knife grate (7), (8), as shown in FIG. 11.

By providing a series of lifter devices for interacting with reversing rollers (9) on the first grate (12) and providing another series of lifter devices for interacting with reversing rollers (9) on the third grate (20), fabrics can be woven in weaves with pile warp threads moving in counterphase (counterphase weaves).

Figure 12:
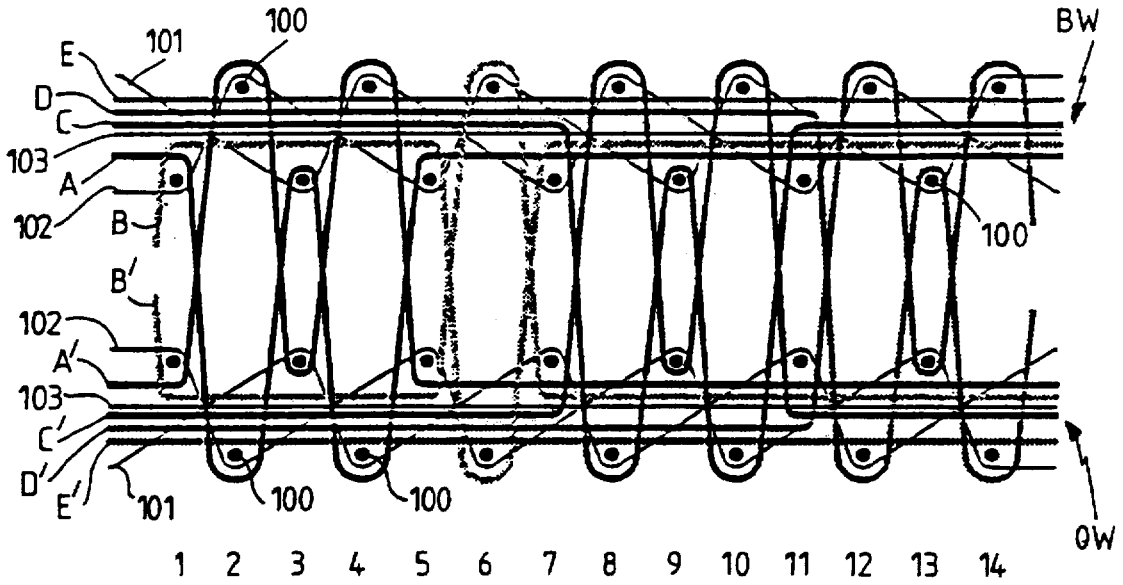
FIG. 12 shows a cross-section in the warp direction of a face-to-face fabric woven according to a counterphase weave.

A cross-section in the warp direction of a face-to-face fabric woven in a counterphase weave is shown in FIG. 12.

The face-to-face fabric shown consists of a top fabric (BW) and a bottom fabric (OW), formed respectively from weft threads (100), and per warp system two binding warp threads (101), (102) and a tension warp thread (103). For each shot (1, 2, 3, . . . ) two weft threads (100) are inserted one above the other. Per warp system ten pile warp threads (A–E, A'–E') are also provided, which threads are either bound into one of the fabrics (BW), (OW), or form pile by being bound off by a weft thread (100) alternately in the top fabric (BW) and the bottom fabric (OW), in a ½ V-weave. The pile warp threads (A–E, A'–E') are subsequently severed between the two fabrics (BW), (OW), so that two pile fabrics are ultimately obtained.

Pile warp threads of five different colors are provided, two pile warp threads being the same color in each case. Of each pair of pile warp threads (A, A'), (B,B'), (C,C'), (D,D'), (E,E') of the same color one is bound into the top fabric (BW) (called the first pile warp thread (A–E)), and one into the bottom fabric (OW) (called the second pile warp thread (A'–E')) when no pile is being formed.

During the formation of pile the pile warp threads of the same pair move in counterphase. For this weave the pile warp threads can assume three different positions relative to the weft threads (100) of a shot (1, 2, 3, . . .): Down, Middle (between the weft threads), and Up.

When the first pile warp thread (A–E) of a pair is in the Up position, the second is in the Down position. This is the case for all pairs of pile warp threads for the first shot (1) in FIG. 12.

When the first pile warp thread (A–E) of a pair is in the Down position, the second is in the Up position. This is the case for the pair of pile warp threads (A,A') for the second shot (2) in FIG. 12.

When the first pile warp thread (A–E) of a pair is in the Middle position, the second is also in the Middle position. This is the case for the pairs of pile warp threads (B,B'), (C,C'), (D,D'), (E,E') for the second shot (2) in FIG. 12.

The jacquard machine according to this invention is easy to adapt for weaving such counterphase weaves. The jacquard machine shown diagrammatically in FIGS. 10 and 11 is arranged for working as a five-position jacquard machine (second grate (11) in a fixed position, and $h_2/h_1=1$.

The lifter devices can lift the pile warp threads to one of the following heights: Down (O), Middle-Down (MO), Middle (M), Middle-Up (MB), and Up (B). If there is an identical selection of hooks (3, 4), (5, 6), a pile warp thread (A–E) which is raised by a lifter device interacting with the first grate (12) moves into a position which relative to the Middle position, is the mirror image of the position of a pile warp thread (A'–E') which is raised by a lifter device interacting with the third grate (20). By means of the lifter devices interacting with the first grate (12) and with the third grate (20), the following respective positions of the pile warp threads are obtained: O, B or MO, MB or M,M, or MB, MO or B,O.

We claim:

1. Jacquard machine with a lifter device comprising first and second lifter elements, plural hooks provided on the device such that each lifter element is suspended from at least one hook respectively, first and second knives for selecting and carry the hooks, said knives being adapted to move up and down in counterphase, a reversing roller, and a lifter cord, first and second grates on the machine, a first roller on the first lifter element and a second roller on the second lifter element, the lift cord having one end attached to the second grate and having a middle portion passed in succession over the first roller, the reversing roller, and the second roller, and another end of the lifter cord being connected to at least one of plural harness cords for lifting a least one warp thread on the weaving loom, the reversing roller being attached to the first grate, wherein each grate is adapted to be disposed either in a fixed position, or in a movable position such that the grate is set in an up and down motion corresponding to a movement of one of the knives.

2. The Jacquard machine of claim 1, wherein the grates are positioned such that a ratio between a lifting height of one of the knives and a lifting height of each grate connected to the respective knife is adjustable.

3. The Jacquard machine of claim 2, further comprising a connecting means for removably connecting each grate to the respective lifter element which is adapted to be movable up and down in phase with one of the knives, and the connecting means further comprising a means for adjusting the ratio of the lifting height.

4. The Jacquard machine of claim 3, further comprising at least one lever having a fixed hinge point, wherein the elements are connected to the at least one lever, and wherein the at least one each lever is connected to a respective grate at least at two positions spaced from the hinge point.

5. The Jacquard machine of claim 4, wherein each lifter element is a knife grate, and further comprising four bars attached to the knife grate, each of the four bars being hingedly attached to an end of the at least one lever and another end of each of the bars being hingedly connected to a fixed part of the Jacquard machine.

6. The Jacquard machine of claim 4, wherein the at least one lever is connected to a grate at four different distances from the hinge point, and wherein the ratio between each of the different distances and the distance between the hinge point and the attachment of the lifter element to the lever is ⅓, ½, ⅔ and 1 respectively.

7. The Jacquard machine of claim 4, wherein the first grate is connectable optionally either to the at least one lever or to a fixed part of the device, and wherein the second grate is connectable optionally either to the first grate or to a fixed part of the Jacquard machine.

8. The Jacquard machine of claim 7, further comprising at least one connecting element having two angle-forming legs attached to the second grate, wherein the at least one connecting element is rotatable about an axis intersecting a corner of the connecting element, and wherein the connecting element is optionally attachable either by one leg to the first grate and by another leg to the fixed part, or attachable by one leg to the first grate, or by one leg to the fixed part.

9. The Jacquard machine of claim 1, wherein the reversing roller is adapted to be disposed hingedly.

10. The Jacquard machine of claim 9, wherein the reversing roller is adapted to be pivotable about an axis extending almost horizontally.

11. The Jacquard machine of claim 1, wherein a working face of the reversing roller extends diagonally relative to respective working faces of the first and second rollers.

12. The Jacquard machine of claim 1, further comprising two sets of first and second lifter elements, wherein the reversing roller when interacting with the one set of lifter elements is attached to the first grate, and wherein the reversing roller when interacting with the other set of lifter elements is attached to a third grate, and wherein the first and the third grate are adapted to move up and down in phase with the first knife and in phase with the second knife respectively.

13. The Jacquard machine of claim 12, wherein the first grate is connected to the first or the second element which is adapted to be movable up and down in phase with one of the knives, and wherein the third grate is either connected to the same lifter element as the first grate by a reversing mechanism, or is connected to the other of the first and the second elements movable up and down in phase with the other of the knives.

14. The Jacquard machine of claim 13, wherein each lifter element is suspended from one hook adapted to be selected for retention at one of two different heights.

15. The Jacquard machine of claim 1, wherein each lifter element interacts with two hooks carried along by the first or the second knives, and further comprising a connecting cord for connecting the lifter elements to each other, wherein each lifter element comprises a top and a bottom lifter roller, and wherein the connecting cord is passed under the top lifter roller and the lifter cord is passed over the bottom lifter roller.

* * * * *